US007739780B2

(12) United States Patent
Muncy et al.

(10) Patent No.: US 7,739,780 B2
(45) Date of Patent: Jun. 22, 2010

(54) METHOD OF MANUFACTURING USING A DIE TO PRODUCE A MACHINED PART

(75) Inventors: John M. Muncy, Princeton, IN (US); Steven Jay Steimel, Decker, IN (US); Richard J. Turner, Princeton, IN (US)

(73) Assignee: Hansen Corporation, Princeton, IN (US)

( * ) Notice: Subject to any disclaimer, the term of this patent is extended or adjusted under 35 U.S.C. 154(b) by 1375 days.

(21) Appl. No.: 11/149,676

(22) Filed: Jun. 9, 2005

(65) Prior Publication Data

US 2006/0277745 A1 Dec. 14, 2006

(51) Int. Cl.
*B23P 11/00* (2006.01)

(52) U.S. Cl. ..... 29/432; 29/432.1

(58) Field of Classification Search ..... 29/412, 29/416, 417, 432, 432.1
See application file for complete search history.

(56) References Cited

U.S. PATENT DOCUMENTS 3,130,489 A * 4/1964 Schlage ..... 29/432
4,805,280 A 2/1989 Elander et al.
5,329,686 A 7/1994 Kildal et al.
6,306,677 B1 10/2001 Vargo et al.
6,539,605 B2 * 4/2003 Baer et al. ..... 29/432.1

FOREIGN PATENT DOCUMENTS

DE 28 14 967 A1 10/1979
DE 35 26 275 C1 12/1986
DE 103 223 02 A1 12/2004

OTHER PUBLICATIONS

English Translation of Chinese Office Action for Application No. 200680020357.X, date of mailing Mar. 6, 2009, 6 pages total.
Office Action of DE Appln No. 102006001387.4, mailed Apr. 6, 2009, 10 page total. [English Translation Included].
Office Action of CN Appln No. 200680020357.x, mailed Mar. 6, 2009, 11 page total. [English Translation Included].

* cited by examiner

*Primary Examiner*—Jermie E Cozart
(74) *Attorney, Agent, or Firm*—Townsend and Townsend and Crew LLP

(57) ABSTRACT

A specific illustrative embodiment of the present invention is disclosed here. The disclosed die tool that will assemble dissimilar materials to form a carrier plate of steel material and an insert of bearing grade material. One die used in the tool is carrier plate itself. The carrier plate provides a die opening to blank and pierce the bearing material into the steel material cavity.

27 Claims, 3 Drawing Sheets

METHOD OF MANUFACTURING USING A DIE TO PRODUCE A MACHINED PART

BACKGROUND OF THE INVENTION

The present invention relates to machining in general, and in particular to a progressive die tool.

In a progressive die tool, a strip or block of material (blank) "progresses" from station to station inside the die, as openings or features are created in the strip. Multiple punches are set in a specific order to produce the desired pattern of openings and features of the machined (manufactured) part.

Machined parts which carry or otherwise bear a load are typically manufactured from a bearing material that is suitable for the designed load. FIG. 4 shows an illustrative example of typical machined part 400. The part is a gearing plate used in motor gear reduction assemblies. Openings 402 are formed in the plate 400 for supporting gearing pivots. As such, these openings are load bearing holes and so the gearing plate 400 is typically made from a bearing material such as bronze, a relatively expensive metal as compared to steel.

As can be seen in FIG. 4, the load bearing openings 402 constitute a very small fraction of the structure of the gearing plate 400. Therefore, the structural advantage of bronze is not used for most of the machined part. There is a need for a tool that can produce lower cost parts by using a lower cost materials, but still provide load bearing surfaces or other load bearing areas in the part that are possible using higher cost materials.

SUMMARY OF THE INVENTION

A die tool for manufacturing a machined part according to the present invention includes receiving a first workpiece from which the machined part is manufactured. The workpiece is machined to serve as a die that is then used to punch our pieces of a second workpiece. The punched out pieces are retained in openings formed in the first workpiece which serve as die openings for the punch operation.

By using a bearing material for the second workpiece, a machined part can be manufactured that comprises primarily of material of the first workpiece and the load bearing portions of the machined part can be formed of the bearing material from the second workpiece.

The manufacturing process is greatly facilitated by using the first workpiece itself as a die in the manufacturing of the machined part. This aspect of the present invention is readily adapted in a progressive die tool.

BRIEF DESCRIPTION OF THE DRAWINGS

Aspects, advantages and novel features of the present invention will become apparent from the following description of the invention presented in conjunction with the accompanying drawings, wherein.

DESCRIPTION OF THE SPECIFIC EMBODIMENTS

Figure 1:
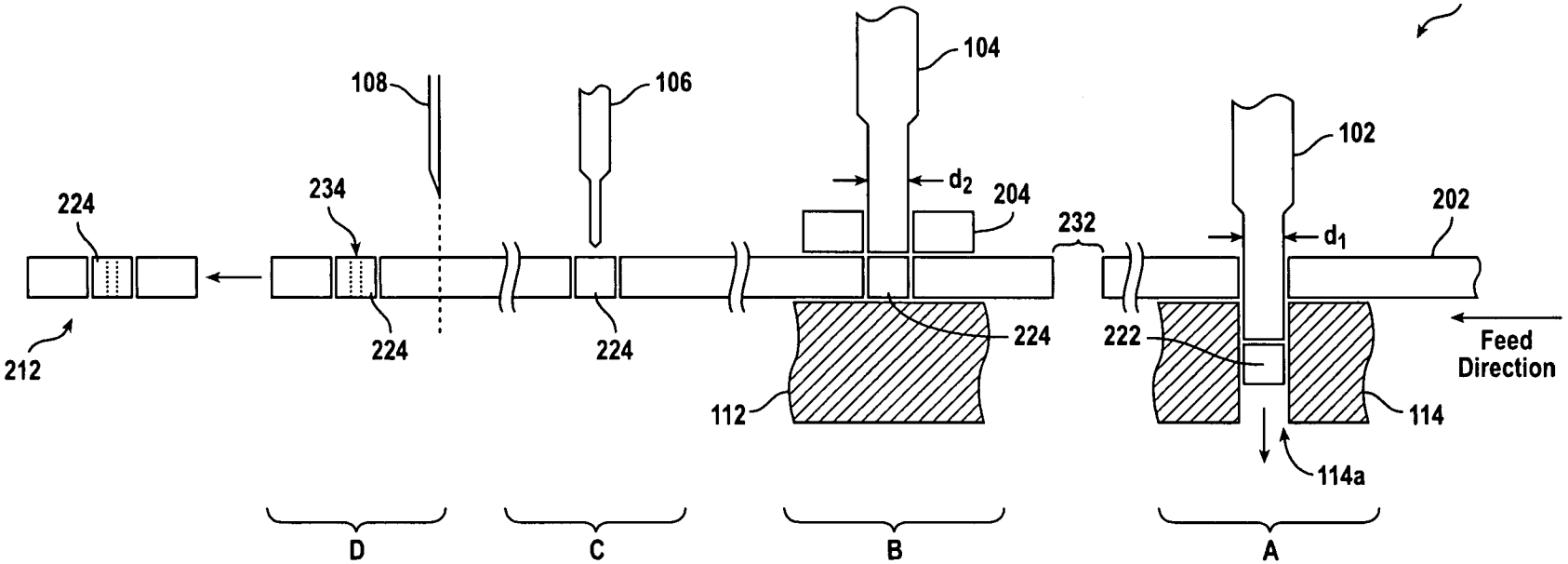
FIG. 1 is a generalized block diagram of a progressive die tool in accordance with the present invention.

A schematic representation of a progressive die tool in accordance with the present invention is shown in FIG. 1. In a progressive die tool, an amount of material (a strip of material, a blank, workpiece, etc) is fed into the tool where a number of stations perform various machining operations on the workpiece. Typically, the workpiece is a continuous strip of material, out of which the machined part is formed, for example, by blanking the final part out of the strip, by cutting segments off of the strip, etc. More generally, however, depending on the complexity of the part to be manufactured, a block of material at a time may be fed into the tool and processed, the resulting part comprising the block of material. FIG. 1 shows a configuration of a progressive die tool in accordance with the present invention that processes a strip of material, from which the resulting machined parts are produced. It will be appreciated from the discussion which follows that many other configurations of a progressive die can be adapted according to the present invention.

The progressive die tool 100 shown in FIG. 1 comprises a number of stations, identified in the figure by the letters A-D. Although only four stations are shown, it is clear that numerous additional stations, or fewer stations, might be appropriate for any given tool. A material feeding system (not shown) feeds a strip of material 202 from the right into the die tool. The strip of material 202 is fed in the direction indicated by the arrow labeled "feed direction." The material feeding system moves the workpiece along from station to station.

A first machining station A includes a punch 102 and die 114 combination. When the strip of material 202 is in position, the punch 102 is operated to pierce the strip of material 202 under suitable control when it reaches station A. An opening 232 can be formed through the strip of material 202 by operation of the punch 102. Although only a single die opening 114*a* in the die 114 is illustrated, the die can be configured with multiple die openings, and the station A can be configured with two or more punches 102 to create multiple openings in the strip of material 202. Alternatively, several punches 102 can be located at multiple positions to create the multiple openings in the strip of material 202.

The punch operation produces one or more slugs 222 punched out of the strip of material 202. The slugs 222 fall through the die opening(s) 114*a* and are typically collected in a catch bin (not shown) and discarded or reclaimed. Typically, a machine controller (not shown) is appropriately programmed to operate the progressive die tool, including coordinating movement of the material feeding system and operation of the progressive die.

As the strip of material 202 is carried by the material feeding system, the one or more openings 232 formed at station A come into position at another machining station B. This is illustrated in FIG. 1 as the opening 232 is shown making its way right to left toward station B. A second strip of material 204 is fed into the station B and arranged or otherwise positioned relative to the openings 232 formed in the strip 202 to cover the openings. The station B includes a punch 104 (typically multiple punches) that is positioned or otherwise aligned with the one or more openings 232 formed in the strip of material. The diameter $d_2$ of the punch 104 is slightly smaller than the diameter $d_1$, of the punch 102. When the punch 104 is operated, it is driven into the second strip of material 204 and into the opening 232, thus blanking a portion of the second strip of material. The portion of the strip of material 202 containing the opening 232 that is located in station B, therefore, serves as a die for the punch operation that is performed in station B. Furthermore, the opening 232 formed in the strip 202 serves as the die opening for the punch operation that is performed in station B, through which the punch 104 is driven in order to pierce the second strip of material 204.

Station B is configured with a stop 112 against which the punch 104 is operated. In this particular embodiment of the present invention, the strip of material 202 is positioned against a surface of the stop 112. Consequently, when the second strip of material 204 is blanked by the punch 104, the slug (insert) 224 produced by the operation is inserted into, and remains within, the opening 232 formed in the strip of material 202.

It can be appreciated of course that if station A produces multiple die openings in the strip 202, then the station B can be configured with multiple punches 104, one aligned with each opening in the strip 202. In this way, multiple inserts 224 can be formed and disposed within the multiple openings in the strip 202 in one operation.

Continuing with FIG. 1, subsequent to the machining operation in station B, the resulting machined portion of the strip of material 202 now includes at least one insert 224 of the material blanked from the strip of material 204. The strip 202 can proceed to another station for an additional machining step (or steps) in order to complete the part. For example, FIG. 1 shows that a station C is configured with a punch 106 to perform a pierce punch operation upon the insert 224 to create a hole 234 within the insert. In the case where there are multiple inserts 224, the station C can be correspondingly configured with multiple punches 106.

It is understood that other machining operations can be performed and that subsequent to the operation performed at station C, the machined portion of strip 202 can be fed to yet additional machining stations (not shown in this particular embodiment). The specific stations provided will of course depend on the part to be manufactured.

As a final step in this process, the machined portion of the strip of material 202 is fed to a station D for a finishing operation. As an example, FIG. 1 shows that the station D is configured with a punch 108. The punch 108 is typically configured to the shape of the final part 212. The punch 108 blanks the completed part out of the strip of material 202; for example, in a stamping operation. The resulting portion separated from the rest of the strip of material 202 constitutes the machined part. 212 It can be appreciated of course that in another configuration, it might be appropriate that the punch 108 is a cutting tool and that the final part 212 is obtained by simply cutting off a piece of the strip of material 202.

As indicated above, the materials used for the material strip 202 and the material strip 204 can be dissimilar materials. For example, in the above-mentioned gear plate example, the material strip 202 can be steel and the material strip 204 can be a bearing material; for example, bronze. In this way, a progressive die tool according to the present invention can be configured to manufacture a part using a low-cost material (the steel), while at the same time incorporating stronger, higher cost materials (e.g., the bronze) in certain areas of the manufactured part where greater structural integrity is required; for example load bearing or load carrying areas in the manufactured part. Since the present invention is directed to the die tool itself and to a method for the die tool, the specific materials that are processed by such a tool is not important. Thus, other combinations of materials can be used. Also, there is no restriction as to the relative hardness of the materials that are fed into the die tool of the present invention.

Figure 2:
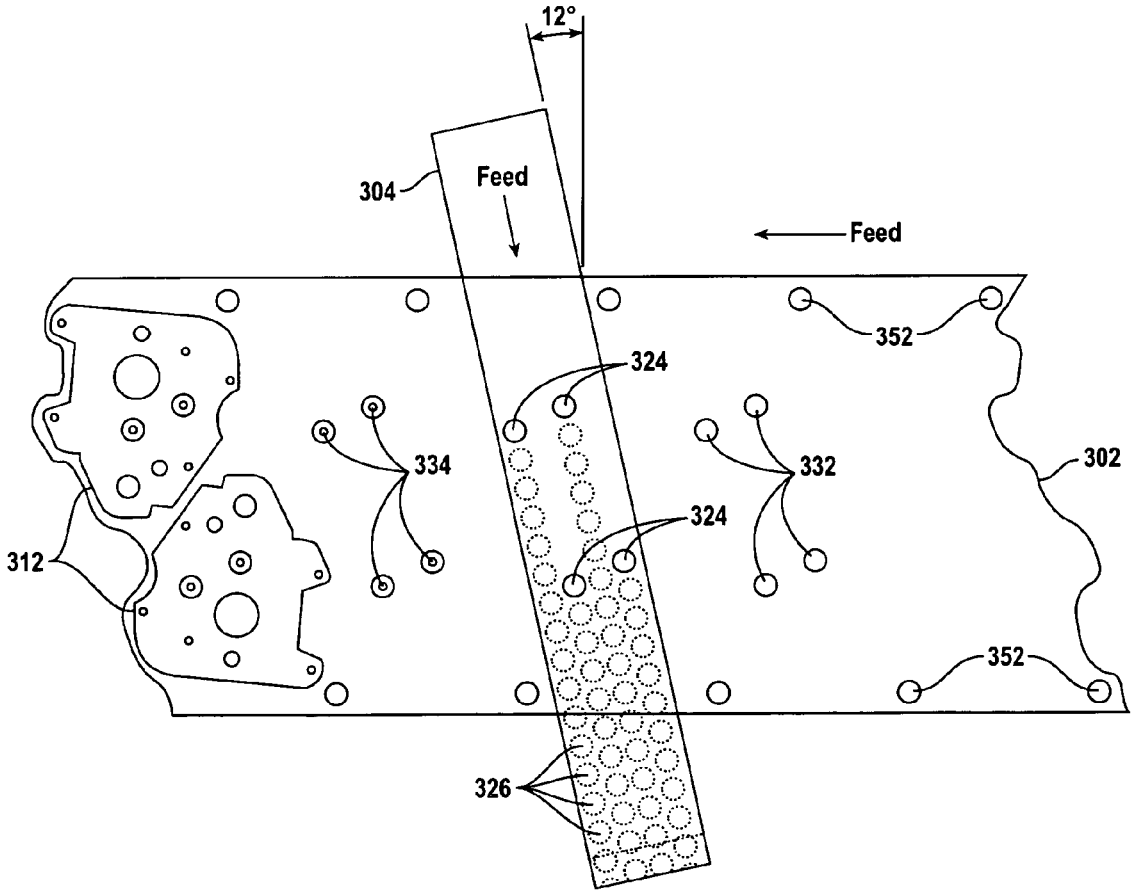
FIG. 2 shows an example of a specific embodiment of the strips of material (workpieces) used in a progressive die tool according to the present invention.

FIG. 2 shows the material strips 202, 204 which are used in the manufacture of a specific part, namely, a gear plate. The figure shows some specific details with respect to a particular embodiment of station B in FIG. 1. Details of this specific illustrative embodiment of the present invention, include feed angle, alignments, and so forth, to provide further understanding for practicing the invention.

FIG. 2 shows a workpiece 302 that is fed into a progressive die tool, an example of which is illustrated in FIG. 1. The workpiece 302 is provided with pilot holes 352 along its upper and lower edges. The pilot holes 352 are used to facilitate alignment of the workpiece 302 within the die tool. In this particular example, the workpiece 302 is formed of steel. However, as noted above, the particular material being processed is not relevant to the present invention.

FIG. 2 shows the movement of the workpiece 302 in the progressive die tool in a right-to-left progression. Thus, a first station in the progressive die tool forms holes 332 in the workpiece 302. As the workpiece 302 moves leftward, the workpiece is processed at a second station where a second workpiece 304 is fed in the direction shown in the figure and covers the holes 332. In this particular example, the second workpiece 304 is formed of bronze, remembering that the particular material being used is not important to the practice of the present invention.

The second station performs a punch operation on the second workpiece 304 using the holes 332 of the first workpieces 302 as die openings for the operation. Thus, the workpiece from which the final part is produced is. A backstop such as shown in FIG. 1 (stop 112) is provided at the second station so that when the second workpiece 304 is blanked the resulting slugs 324 do not pass through the holes 332 of the workpiece 302, but instead are received in the holes.

For the particular parts being manufactured, the holes are 332 are formed in the workpiece 302 such that an optimal feed angle of the second workpiece 304 is possible. In this particular illustrative example, the feed angle of the second workpiece 304 is 12° from a line perpendicular to the feed direction of the workpiece 302. The result is an optimal usage of the material of the second workpiece 304, as indicated by the pattern of punched out holes 326 in the second workpiece.

As movement of the workpiece 302 progresses leftward, the inserted slugs 324 are processed at a third station in the progressive die to form pivot holes 334 within the slugs 324. Gear plates 312 are then trimmed out of the workpiece 302 as manufactured parts. The resulting gear plates 312 include the inserted slugs 324.

Figure 4:
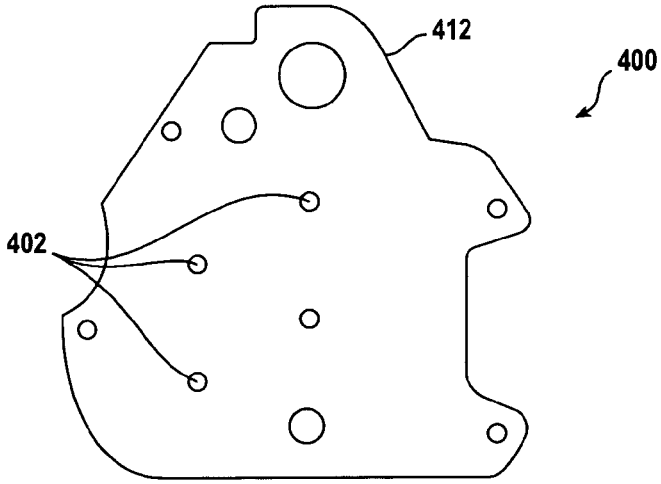
FIG. 4 shows a machined part manufactured according to conventional techniques.
Figure 5:
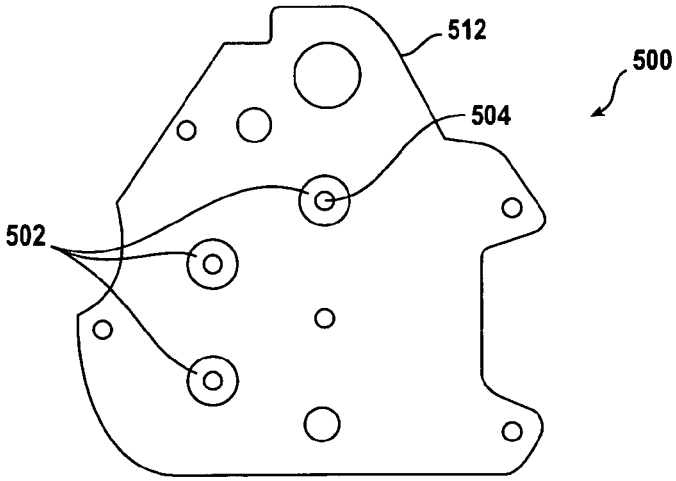
FIG. 5 shows a machined part manufactured according to the present invention.

FIG. 5 shows an example of gear plate 500 manufactured in accordance with the present invention. The gear plate shown in FIG. 5 includes three bronze inserts 502, having a pivot hole 504 punched into each insert. The pivot holes 504 support gear pivots in an assembled unit. The carrier plate 512 is steel, while the inserts 502 are of a bearing grade material; in this case, bronze. Since only a few pivot holes are required, the bulk of the gear plate material can be lower cost steel, while the more expensive bronze is used only where it is needed. By comparison, the gear plate 400 in FIG. 4 is manufactured in accordance with conventional machining practice and is entirely of bronze, and so is more expensive to produce. A progressive die tool in accordance with the present invention is capable of manufacturing a lower cost part and still provide similar mechanical characteristics (e.g., load bearing performance) of a more expensive part manufactured according to conventional practice.

Return now to FIG. 1. As discussed above, station B performs a punch operation using the workpiece itself (strip 202) as a die, and an opening 232 formed in the workpiece serves as the die opening. A stop 112 prevents the slug 224 that is punched out of the second strip of material 204 from falling through the opening 232. In this way, the slug 224 is retained within the workpiece as an element of the manufactured part. Moreover, FIG. 1 shows that the slug 224 is flush with respect to the upper and lower surfaces of the workpiece 202.

Figure 1A:
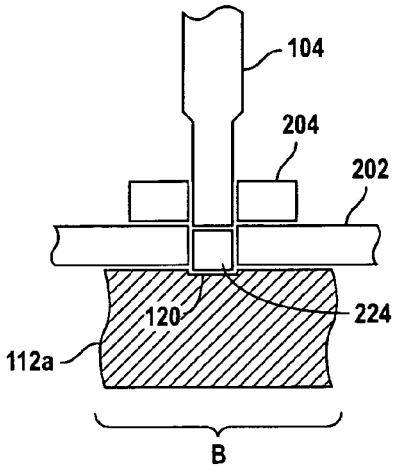
FIG. 1A shows an alternative configuration of the stop in station B.
Figure 1B:
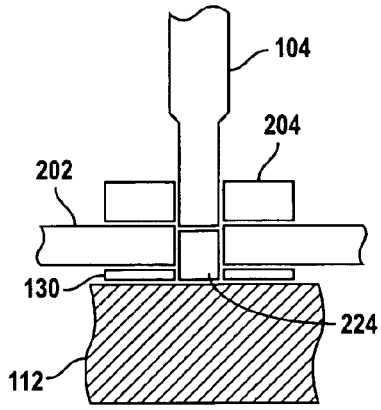
FIG. 1B shows another alternative configuration of the stop in station B.

FIG. 1A shows an example of an alternate configuration of the stop 112 shown in FIG. 1. A modified stop 112*a* shown in FIG. 1 includes a recessed portion 120 formed in its surface. This allows for the punch operation at station B to push slug 224 partly beyond the bottom surface of the workpiece 202. For a particular part, this may be desirable. FIG. 1B shows an alternative configuration wherein a shim 130 is placed on the stop 112 to achieve a similar result.

Figure 3A:
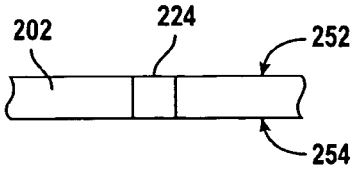
FIGS. 3A-3D illustrate alternative configurations of the inserts.
Figure 3B:
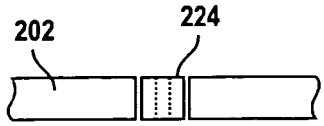
Figure 3C:
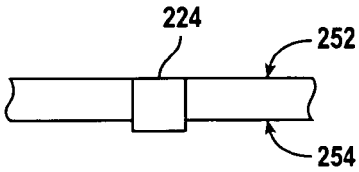
Figure 3D:
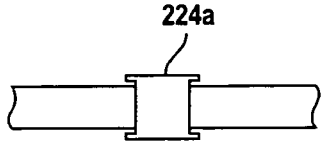

FIGS. 3A-3D show examples of alternative configurations of the slug insert 224. FIG. 3A shows the insert 224 is flush with the major surfaces 252, 254 of the workpiece. FIG. 3B shows the insert 224 having been subjected to a machining operation subsequent to being blanked into the workpiece 202. FIG. 3C shows the insert 224 protruding beyond one of the major surfaces (i.e., 254) of the workpiece 202. FIG. 3D shows a flanged insert 224a. It can be appreciated from these figures and from FIGS. 1A and 1B that many other configurations are possible.

What is claimed is:

1. A method of manufacture using a die to produce a machined part comprising:

receiving a first workpiece of a first material out of which the machined part is produced;

forming one or more die openings in the first workpiece; and punching a second workpiece of a second material to produce one or more slugs separated completely therefrom using only the one or more die openings of the first workpiece as guides for the punching operation, wherein the machined part also serves as a die for the punching operation.

2. The method of claim 1 wherein the punching operation leaves the one or more slugs disposed within the one or more die openings of the first workpiece, thereby producing one or more inserts of the second material within the first workpiece.

3. The method of claim 2 further comprising performing one or more additional machining operations on the first workpiece or the one or more inserts.

4. The method of claim 2 further comprising obtaining the machined part by separating a portion of the first workpiece from the remainder of the first workpiece, the separated portion including at least some of the one or more inserts.

5. The method of claim 4 wherein the separating includes severing the portion of the first workpiece from the remainder of the first workpiece.

6. The method of claim 4 wherein the separating includes cutting out the portion of the first workpiece from the first workpiece.

7. The method of claim 6 wherein the cutting out is a step of blanking the first workpiece with a punch that has the shape of the machined part, thereby obtaining the machined part.

8. The method of claim 7 wherein the inserts serve to carry a load.

9. The method of claim 7 wherein the inserts serve as a load bearing surface.

10. The method of claim 1 wherein the one or more die openings are formed through first and second major surfaces of the first workpiece.

11. A method of using a die to produce a manufactured part, the manufactured part comprising a plate of a first material having incorporated therein one or more areas of a second material, the method comprising:

receiving a first blank formed of the first material from which the manufactured part is produced;

forming one or more openings through the first blank;

aligning a second blank formed of a second material relative to the first blank to overlie at least one opening among the one or more openings;

punching an amount of material of the second blank into the at least one opening of the first blank, wherein only the at least one opening serves as a guide for the punching operation, wherein the amount of material is completely separated from the second blank; and repeating the aligning and punching operations for a remainder of the one or more openings.

12. The method of claim 11 wherein the amount of material that is punched into the first blank is flush with first and second major surfaces of the first blank.

13. The method of claim 11 wherein the amount of material that is punched into the first blank is flush with a first major surfaces of the first blank and protrudes from a second major surface of the first blank.

14. The method of claim 11 wherein the amount of material that is punched into the first blank protrudes from first and second major surfaces of the first blank.

15. The method of claim 11 further comprising performing a machining operation on the amount of material that is punched into the first blank.

16. The method of claim 11 further comprising forming an opening in the amount of material that is punched into the first blank.

17. The method of claim 11 wherein the amount of material of the second blank occupies substantially all of the volume of space of the at least one opening of the first blank.

18. A method of using a progressive die to produce a machined part comprising:

receiving a first strip of material; and punching one or holes through a segment in the first strip;

performing a piercing operation using only the one or more holes in the segment of the first strip to punch one or more holes in a second strip of material such that slugs produced by the piercing operation are disposed at least partially in the one or more holes in the segment of the first strip, wherein the machined part comprises a portion of the first strip within which slugs completely separated from the second strip are inserted.

19. The method of claim 18 further comprises cutting the portion of the first strip that constitutes the machined part from the rest of the first strip, thereby producing the machined part.

20. The method of claim 18 further comprising performing a machining operation on the slugs of the second strip that are inserted in the first strip.

21. The method of claim 18 further comprising aligning the second strip relative to the first strip to occlude at least some of the one or more holes in the first strip.

22. The method of claim 18 wherein each slug separated from the second strip occupies substantially the entire of a corresponding hole in the first strip.

23. A method for a progressive die to produce a manufactured part comprising:

performing a first punch operation at a machining station to form a plurality of holes in a first workpiece;

performing a second punch operation at another machining station to form a plurality of holes in a second workpiece, including using only the holes in the first workpiece as die openings during the second punch operation wherein material of the second workpiece produced by the second punch operation is completely separated from the second workpiece and retained in the holes of the first workpiece; and performing a finishing operation on the first workpiece at yet another machining station to produce a manufactured part comprising at least a portion of the first workpiece having inserted therein portions of the second workpiece, wherein the first workpiece constitutes a portion of the manufactured part and also serves as a die in the second punch operation.

24. The method of claim 23 further comprising severing a portion of the first workpiece at still yet another machining station to produce the manufactured part.

25. The method of claim 23 wherein the second punch operation includes:

covering at least some of the holes in the first workpiece with the second workpiece;

aligning one or more punches with said at least some of the holes of the first workpiece wherein the second workpiece is disposed between the first workpiece and the one or more punches; and driving the one or more punches through the second workpiece and at least partially into said at least some of the holes of the first workpiece thereby piercing the second workpiece and leaving slugs of the second workpiece in said at least some of the holes of the first workpiece.

26. The method of claim 23 wherein the finishing operation includes a machining operation that is performed on pieces of the second workpiece that are inserted in the first workpiece.

27. The method of claim 23 wherein the material of the second workpiece produced by the second punch operation occupies substantially all of the volume of space of the holes of the first workpiece.

* * * * *